United States Patent [19]

Ogino et al.

[11] Patent Number: 4,511,327

[45] Date of Patent: Apr. 16, 1985

[54] OIL BURNER

[75] Inventors: Toshiro Ogino, Sakurai; Katsuzo Kokawa, Nara, both of Japan

[73] Assignee: Matsushita Electric Industrial Co., Ltd., Osaka, Japan

[21] Appl. No.: 458,446

[22] Filed: Jan. 17, 1983

[30] Foreign Application Priority Data

Jan. 19, 1982 [JP] Japan ..... 57-7036
Mar. 17, 1982 [JP] Japan ..... 57-43470

[51] Int. Cl.[3] ..... F23D 5/00

[52] U.S. Cl. ..... 431/201; 431/195; 431/347; 126/96

[58] Field of Search ..... 431/201, 200, 326, 329, 431/350, 195, 302, 347; 126/110 B, 110 C, 110 D, 95, 96

[56] References Cited

U.S. PATENT DOCUMENTS 1,395,187 10/1921 Kaufman ..... 431/195
2,621,721 12/1952 Manteria ..... 431/347
3,199,505 8/1965 Lloyd ..... 126/95
3,734,677 5/1973 Murase et al. ..... 431/347

FOREIGN PATENT DOCUMENTS 287698 2/1965 Netherlands ..... 431/201

*Primary Examiner*—James C. Yeung
*Assistant Examiner*—Noah P. Kamen
*Attorney, Agent, or Firm*—Stevens, Davis, Miller & Mosher

[57] ABSTRACT

A double-cylinder type oil burner having an inner flame cylinder and an outer flame cylinder. A red-heatable cylinder is connected to the upper end of the inner flame cylinder with a secondary air inlet left therebetween. A damper mechanism for varying the opening in the upper end of the red-heatable cylinder is provided on the upper end of the red-heatable cylinder. According to this arrangement, it is possible to vary the burning rate over a wide range and to vary the red-heated area in accordance with the rate of burning.

2 Claims, 5 Drawing Figures

OIL BURNER

BACKGROUND OF THE INVENTION

1. Field of the Invention

The present invention relates to an oil burner for burning a liquid fuel.

2. Description of the Prior Art

Such oil burners have been known as having a combustion chamber defined between a porous inner flame cylinder and a porous outer flame cylinder, the combustion chamber generating a gas of high temperature which red-heats a red-heatable body such as a wire netting, punched metal, metal screen or the like. The oil burner of the kind described, typically oil stoves, are now becoming major household heaters because of various advangages such as elimination of the necessity for electric power supply, small size and light weight which permit easy handling, small possibility of trouble, pleasant feel of heating due to heat radiation and so forth.

The oil burner of the type concerned has a combustion cylinder of a construction which will be described hereinunder with reference to FIG. 1.

A reference numeral 1 designates a wick the lower end of which is immersed in the fuel contained in a fuel tank (not shown) disposed at the lower side thereof, while the upper end is exposed to the combustion chamber. A reference numeral 2 designates an inner flame cylinder, while 3 designates an outer flame cylinder. Both of these cylinders 2 and 3 have numerous apertures formed in their walls. A combustion chamber is formed between the inner flame cylinder 2 and the outer flame cylinder 3. A red-heatable cylinder 4 connected to the upper end of the outer flame cylinder 3 is produced from a metal screen, punched metal, wire netting or the like, and has a porosity greater than that of the outer flame cylinder 3. An outmost cylinder 5 is made of a heat-resistant and light-transmissing material such as a glass, and is held by a metallic cylinder 6. A reference numeral 7 denotes an upper cover connected to the upper end of the inner flame cylinder 2 and having air holes 7*a*. A flame settling plate 7*b* is fixed to the upper cover 7.

In the steady state of burning, the liquid fuel is evaporated from the end of the wick to form a fuel gas which is mixed with air supplied by natural draft through the small apertures in the inner and outer flame cylinders 2, 3 and the red-heatable cylinder 4 as well as various openings so that the fuel is partly burnt. The remaining fuel is burnt up by the supply of air (secondary air) through the upper cover 7. This burning system encounters the following problems. Namely, the supply of air (primary air) on the way of flow of the fuel gas to the position of secondary burning (position where secondary air is supplied) is made in quite a dispersed manner through apertures in the inner and outer flame cylinders, so that the concentration of unburnt gas is made smaller at the upper portion of the combustion chamber than at the lower portion of the same. Such uneven concentration distribution makes the perfect burning quite difficult.

To obviate this problem, a method has been adopted in which air is supplied concentrically while forming an adequate concentration of unburnt gas thereby to perfectly burn up the fuel gas in the upper part of the combustion chamber. According to this method, however, the heat produced through the secondary burning does not contribute at all to the red-heating of the red-heatable sleeve 4 so that the ratio of the radiation energy to the fuel consumption is low: namely, the radiation efficiency is impractically low.

When the height of exposed portion of the wick 1 is reduced to decrease the rate of evaporation of the fuel, the degree of red-heating of the red-heatable sleeve 4 is not substantially changed although the flame in the secondary burning region is reduced. This means that the user cannot visually recognize from the appearance of the red-heatable sleeve 4 any reduction of burning rate. In consequence, the user often reduces the exposure height of the wick excessively to cause a burning failure due to excessive air, resulting in the generation of carbon monoxide or offensive odor.

SUMMARY OF THE INVENTION

Accordingly, an object of the invention is to provide an oil burner which offers advantages such as (a) large red-heat area and high heat radiation efficiency, (b) a sensitive change or control of red-heat area in response to a change in the burning rate and (c) wide range of adjustment of burning rate without deterioration of gas emitting condition.

These and other objects, features and advantages of the invention will become clear from the following description of the preferred embodiment taken in conjunction with the accompanying drawings.

DETAILED DESCRIPTION OF THE PREFERRED EMBODIMENT

Figure 2:
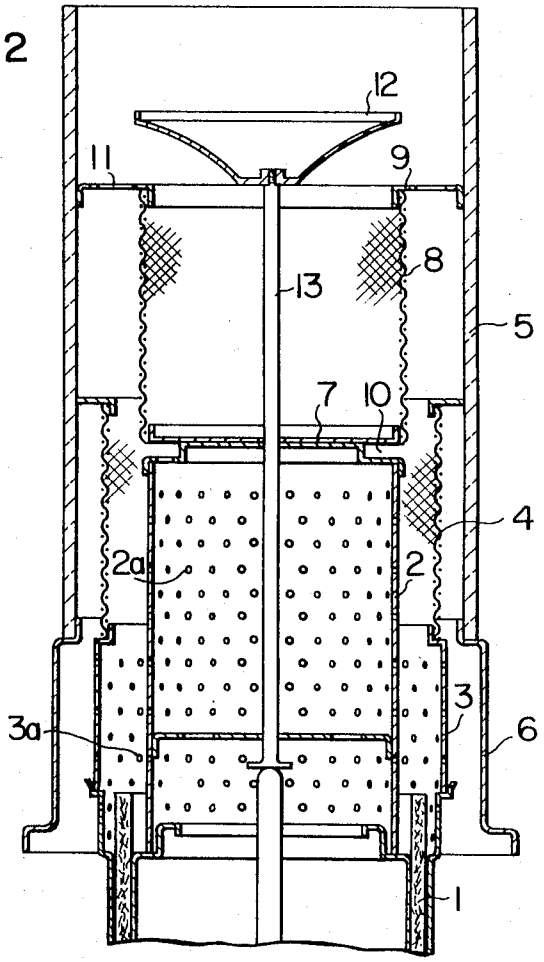
FIG. 2 is a sectional view of an essential part of an oil burner in accordance with an embodiment of the invention.

Referring to FIG. 2 showing an essential part of an oil burner in accordance with an embodiment of the invention, a reference numeral 1 designates a cylindrical wick which is immersed at its lower end portion in a fuel tank (not shown) provided at a lower portion of the oil burner. The upper end portion of the wick is disposed into the combustion chamber. An inner flame cylinder 2 has numerous small apertures 2*a*. An outer flame cylinder which surrounds the inner flame cylinder 2 also has numerous small apertures 3*a*. A first red-heatable cylinder 4 connected to the upper end of the outer flame cylinder 3 is made of metal screen, punched metal, wire netting or the like. A light-transmitting outermost cylinder 5 made of a heat-resistant and light-transmitting material such as glass is held by a metallic outermost cylinder 6. The inner flame cylinder 2, outer flame cylinder 3 and the metallic outermost cylinder 6 are held substantially coaxially by suitable means. A partition plate 7 is connected to the inner flame cylinder 2. A second red-heatable cylinder made of metal screen, punched metal, wire netting or the like is held by an upper cover 9 provided with air holes 11. A slit-shaped air inlet 10 (secondary air inlet) is formed between the inner flame cylinder 2 and the second red-heatable cylinder 8. A damper 12 is movable up and down by the manipulation of an external burning rate adjusting mechanism through the operation of a connecting rod 13.

In operation, as fire is set on the end of an wick 1, the liquid fuel is evaporated from the wick 1 by the heat of the fire and by the natural draft of air sucked through the small apertures formed in the lower end portions of the inner flame cylinder 2 and the outer flame cylinder 3. The evaporated fuel is then mixed with air supplied through the small apertures of entire portions of the inner flame cylinder 2 and outer flame cylinder 3, as well as the opening of the red-heatable cylinder 4 and is burnt partially. Since the burning proceeds in a progressive manner, a part of the air-fuel mixture gas, i.e. the unburnt gas, ascends through the combustion chamber so that the concentration of the evaporated gas is gradually decreased as the gas flows upwardly. When the unburnt gas reaches the area around the secondary air inlet 10, the secondary air is supplied to the gas concentrically so that the gas is burnt rapidly to cause a rise of the burning temperature which ensures a substantially perfect burning. When the rate of evaporation of the fuel is large, i.e. when the burning is taking place at a large rate, the concentration of the evaporated fuel gas around the secondary air inlet is high so that the burning time is prolonged and the length of the flame is increased. When the secondary air inlet has a slit-like form, the seconday air is supplied over the entire periphery of the secondary flame so that the area of contact between the flame and the air is increased so that, in the course of upward propagation of flame in contact with the second red-heatable cylinder 8, convexities and concavities in the surface of the red-heatable cylinder 8 produces eddy currents of the unburnt gas in the flame to promote the mixing of the unburnt gas with the air so that the gas can be burnt substantially perfectly to red-heat also the second red-heatable cylinder 8. If there is any presence of non-preheated air in the vicinity of the red-heatable cylinder 8, such air cools the flame causing the burning to be interrupted so as to result in serious degradation in the gas emission characteristics of the oil burner. To avoid such an inconvenience, in the described embodiment of the invention, the flow of air from the inner side is effectively avoided by the partition plate 7.

Figure 5:
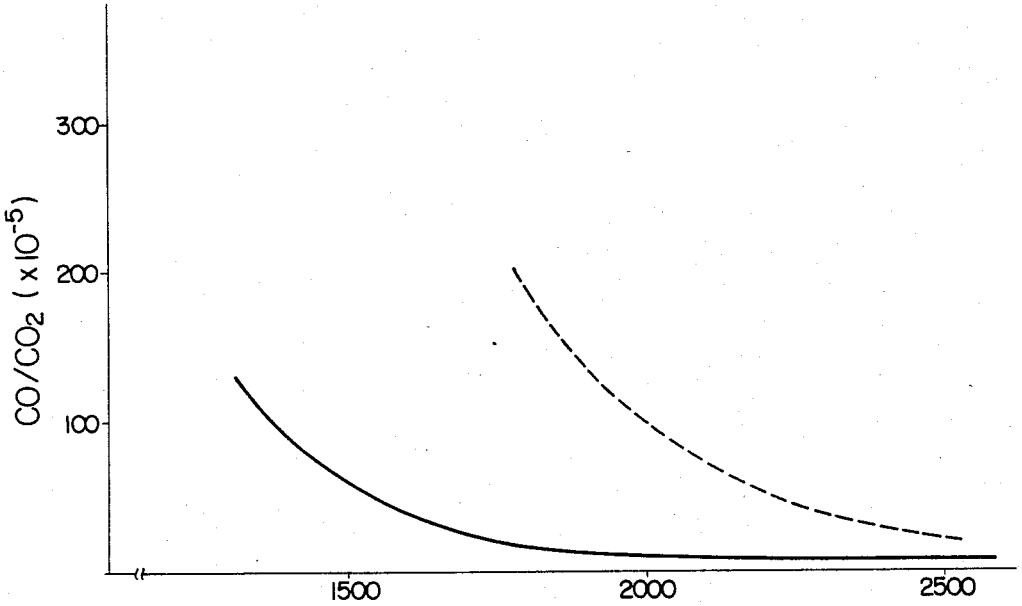
FIG. 5 is a chart showing the gas emission characteristics of the oil burner of the invention in comparison with that of a conventional oil burner in terms of the ratio $CO/CO_2$.

By adequately selecting the position of the secondary air supply, it is possible to perfectly burn the fuel gas through the secondary burning, before the air-fuel mixture becomes excessively lean. The rate of evaporation of fuel depends on the temperature of the evaporation surface and the partial pressure of the fuel gas in the vicinity of the evaporation surface. More specifically, it is possible to obtain an evaporation rate substantially proportional to the rate of supply of air to the area around the evaporation surface. More specifically, if the rate of supply of air to the area around the evaporation surface is increased, the partial pressure of the fuel gas is decreased to increase the rate of evaporation of the fuel from the wick surface. To the contrary, if the rate of supply of air to the area around the evaporation surface is decreased, the partial pressure of the gas is increased to suppress the evaporation of the fuel. The heat applied to the wick 1 and, hence, the temperature of the wick 1 can be made constant by forming pore-burning in the small apertures in the lower portion of the inner flame cylinder 2 and the outer flame cylinder 3 near the wick 1, so that the evaporation can be changed merely by changing the rate of air supply to the area around the wick 1, substantially in proportion to the rate of air supply. According to this arrangement, the supply rate of air for evaporation (air supplied through lower portions of the inner cylinder 2 and the outer cylinder 3) and the air for burning (air supplied through small apertures in the inner flame cylinder 2 and the outer flame cylinder 3, air supplied through the opening in the red-heatable cylinder 4 and the secondary air supplied through the air inlet 10) are changed substantially in proportion to each other, so that the ratio between the fuel and the air, i.e. the air surplus ratio, is maintained substantially constant. It is, therefore, possible to maintain a good state of burning over a wide range of burning with minimal generation of carbon monoxide as will be seen from FIG. 5.

Figure 1:
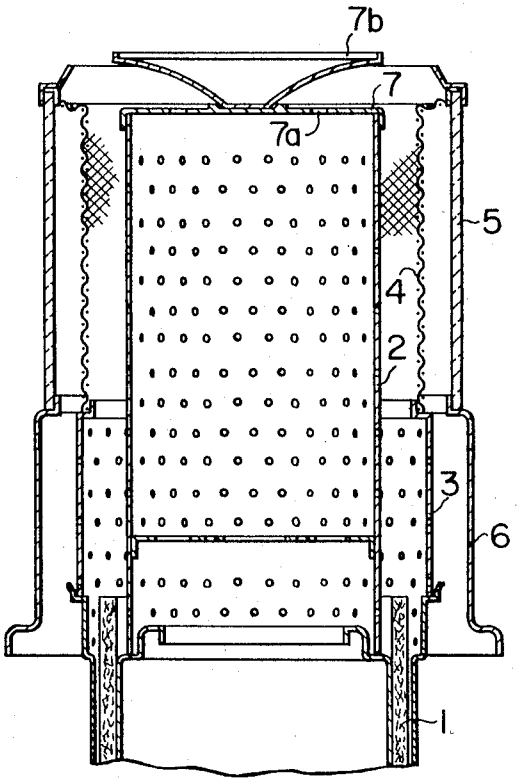
PRIOR ART FIG. 1
FIG. 1 is a sectional view of an essential part of a conventional oil burner.
Figure 3:
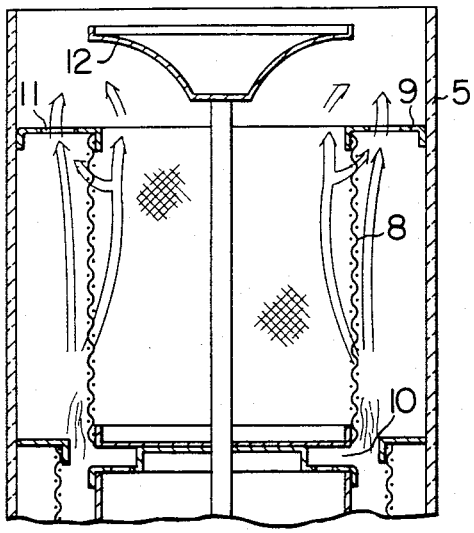
FIG. 3 is a sectional view of the oil burner shown in FIG. 2, in the state in which the burner is operating at a large burning rate.
Figure 4:
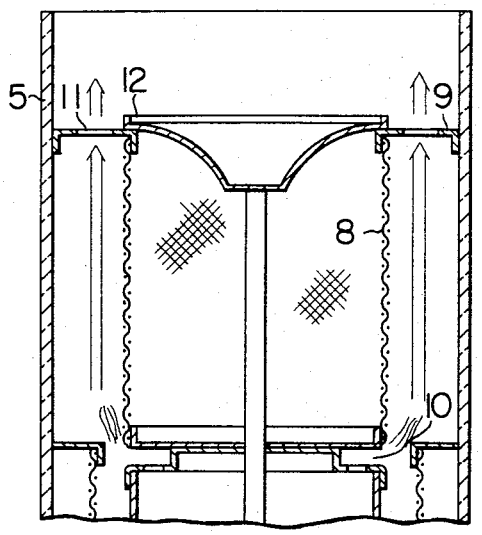
FIG. 4 is a sectional view of the oil burner shown in FIG. 2 in the state in which the oil burner is operating at a small burning rate.

On the other hand, the heat generated as a result of burning taking place in the burning chamber between the first burning cylinder 4 and the inner flame cylinder 2 red-heats the first burning cylinder 4, while the remaining unburnt gas is mixed with the air supplied through the secondary air inlet 10 and burnt to produce hot gas which flows upwardly through the gap formed between the second red-heatable cylinder 8 and the outermost cylinder 5. When the damper 12 takes the upper position to open the passage as shown in FIG. 1, the hot gas flows substantially along the second red-heatable cylinder 8 and is discharged to the outside through the upper opening of the second red-heatable cylinder 8 and the air holes 11 formed in the upper cover 9. In consequence, the entire surface of the second red-heatable cylinder 8 is heated substantially uniformly over its entire surface. To the contrary, when the movable damper 12 takes the lowered position to close the upper portion of the second red-heatable cylinder 8, the hot gas is allowed to flow out of the burner only through the air holes 11, so that the resistance imposed upon the flow of air is increased to lower the draft force. In consequence, the rate of supply of air is decreased to suppress the rate of air supply as explained before, so that the hot gas flows along a path which is spaced apart from the second red-heatable cylinder 8. As a result, the red-heat temperature of the second red-heatable cylinder 8 is decreased drastically and, in addition, the generation of carbon monoxide atributable to the cooling of the flame is reduced because the flame contained by the flow of hot gas is less liable to contact with the second red-heatable cylinder 8 of low temperature.

Although the invention has been described through specific terms, it is to be noted here that the described embodiment is not exclusive and various changes and modifications may be imparted thereto without departing from the scope of the invention which is limited solely by the appended claims.

What is claimed is:

1. An oil burner comprising: an inner flame cylinder having numerous small apertures, an outer flame cylinder having numerous small apertures, said outer flame cylinder being spaced from and surrounding said inner flame cylinder, an outermost cylinder surrounding said outer flame cylinder, a light transmitting outermost cylinder connected to an upper end of said outermost cylinder; a first red-heatable cylinder connected to an upper end of said outer flame cylinder, said first red-heatable cylinder being spaced from and surrounding said inner flame cylinder and having numerous small apertures, a partition plate disposed above said inner flame cylinder and spaced a predetermined distance above a top portion of said inner flame cylinder, a secndary air inlet disposed adjacent to a space between said partition plate and said top portion of said inner flame cylinder, said secondary air inlet for receiving preheated air from a space between said first red-heatable cylinder and said inner flame cylinder, a second red-heatable cylinder disposed above and connected to said partition plate, said partition plate comprising means for preventing non-preheated air from flowing into an interior of said second red-heatable cylinder directly from an interior of said inner flame cylinder, said second red-heatable cylinder having numerous small apertures and an opening in its upper end, and a damper mechanism for varying an opening in an upper end of said second red-heatable cylinder.

2. An oil burner according to claim 1, further comprising means for maintaining the rate of evaporation of fuel substantially in proportion to the rate of air supply.

* * * * *